US005558151A

United States Patent [19]

Gilbert et al.

[11] Patent Number: 5,558,151

[45] Date of Patent: Sep. 24, 1996

[54] DIE CASTING MOLD HAVING LOCK RINGS FOR MOUNTING AN INSERT TO A MANDREL

[75] Inventors: Michael V. Gilbert, Oolitic; Bradley C. Menaugh, Mitchell, both of Ind.

[73] Assignee: General Motors Corporation, Detroit, Mich.

[21] Appl. No.: 574,173

[22] Filed: Dec. 18, 1995

[51] Int. Cl.[6] ..... B22D 17/24

[52] U.S. Cl. ..... 164/312; 164/333; 164/334

[58] Field of Search ..... 164/332, 333, 164/334, 312, 112

[56] References Cited

U.S. PATENT DOCUMENTS 2,313,674 3/1943 Salzberg et al. .

4,873,114 10/1989 Harris .

5,178,202 1/1993 Dannoura et al. ..... 164/334 X 5,320,157 6/1994 Siak et al. ..... 164/12

FOREIGN PATENT DOCUMENTS 4-339556 11/1992 Japan ..... 164/332

*Primary Examiner*—J. Reed Batten, Jr.

*Attorney, Agent, or Firm*—Lawrence B. Plant

[57] ABSTRACT

A cylinder liner for an internal combustion engine is held onto a detachable mandrel portion of a die by a plurality of split-ring-type compression springs. A sliplock on the ends of the split-ring spring limits the extent to which the spring can open or close.

4 Claims, 2 Drawing Sheets

DIE CASTING MOLD HAVING LOCK RINGS FOR MOUNTING AN INSERT TO A MANDREL

This invention relates to die casting molds for casting internal combustion engine blocks having discrete cylinder liners insert-molded into the block.

BACKGROUND OF THE INVENTION

Koch et al U.S. Pat. No. 4,981,168 discloses a method and apparatus for casting an internal combustion engine block having a discrete cylinder liner prepositioned in the mold and the block metal (e.g., aluminum) cast thereabout. More specifically, Koch et al utilize a reuseable, cylindrical, detachable mandrel for positioning the cylinder liner in the mold cavity. The cylinder liner is mounted onto the detachable mandrel outside of the mold, and the mandrel-liner assembly then positioned in the mold cavity just prior to casting. After casting, the cylinder block is removed along with the liner and mandrel. Thereafter, the mandrel is pressed out of the cylinder block and reused. In a horizontally parted die, the upper ejector half of the die will typically contain the mandrel hanging down therefrom, and provision must be made to prevent the liner from falling off of the mandrel (i.e., due to gravity) once the mandrel has been positioned in the upper ejector die.

SUMMARY OF THE INVENTION

The present invention contemplates an effective technique for holding a cylinder liner on a mandrel attached to the upper, ejector die portion of a horizontally parted die casting mold. More specifically, the invention comprises a die casting mold for casting an IC engine block which has a discrete cylinder liner prepositioned in the mold cavity for embedment in metal cast thereabout to form the block. The cylindrical liner has an inside diameter and inner cylindrical surface, and is positioned within the mold by means of a reuseable, cylindrical, mandrel detachable from the mold which positions the liner in the mold cavity during casting. The mandrel is removed with the block after casting and is pressed out of the block after cooling. In accordance with the present invention, the reuseable mandrel has at least two spaced apart annular grooves in its outside surface. A split-ring-type, radially compressible and expansible spring is placed in each of the grooves. The spring has a leading edge for first engaging the liner during its placement on the mandrel, and a pair of ends proximate each other, and moveable to and fro relative to each other during placement and displacement of the liner on and off the mandrel respectively. The outside diameter of the spring is greater than the inside diameter of the liner when the spring is in an uncompressed state. A chamfer is provided on the leading edge of the spring for engaging an edge of the liner during its placement on the mandrel, and camming the spring radially inwardly to a compressed state when the liner is slipped over the mandrel. As a result, the spring radially expands outwardly against the inner cylindrical surface of the liner and holds the liner in position on the mandrel even after the mandrel is positioned in the overhead moveable/ejector portion of the die. Preferably, the split-ring-type spring includes a sliplock on the ends of the ring which permits relative movement of the ends, but limits how far the split ring can be opened and closed. Most preferably, the sliplock will comprise a pair of opposing hooks on the ends of the spring which hooks are linked to each other to limit the to and fro motion of the spring ends.

DETAILED DESCRIPTION OF THE PREFERRED EMBODIMENT

The invention will better be understood when considered in the light of the following detailed description of a certain specific embodiment thereof which is given hereafter in conjunction with the several figures in which.

Figure 1:
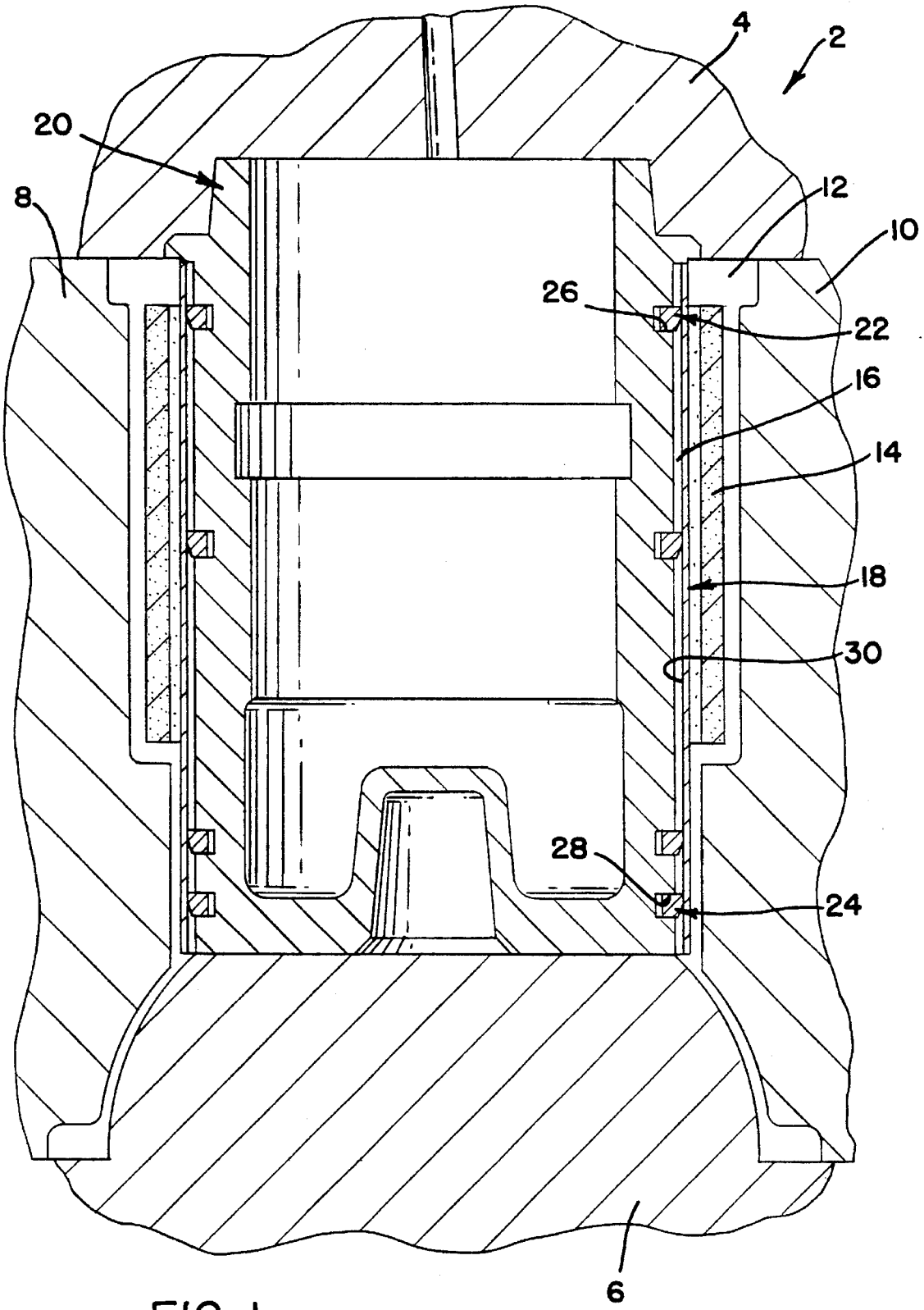
FIG. 1 is a sectioned view of a portion of a die casting die in accordance with the present invention.

FIG. 1 depicts a die casting mold 2 having an upper moveable or ejector die portion 4, a lower stationary or fixed die portion 6 and two slidable side, die portions 8 and 10 which come together in a "die-closed" position to form a molding cavity 12 into which molten metal is injected to form an engine block. An expendable sand core 14, or the like, is provided in the molding cavity 12 which is removed after casting the metal to define a cooling jacket in the block surrounding the block's combustion chamber 16. When the block is formed from a light metal such as aluminum it is common to position an iron liner 18 in the mold cavity 12 before injecting the molten aluminum. After solidification, the molten aluminum adheres to the iron cylinder liner 18, and the block is ejected from the mold 2 along with the cylinder liner 18.

As taught by Koch U.S. Pat. No. 4,981,168, the mold 2 includes a reuseable cylindrical detachable mandrel 20 which has the iron liner 18 secured thereto during casting. In accordance with the present invention, the liner 18 is secured to the mandrel 20 by means of at least two (preferably more) split-ring-type, radially compressible and expansible springs 22 and 24. The split-ring-type springs 22, 24 are carried in annular grooves 26 and 28 formed in the outside surface of the mandrel 20. The liner 18 has an inner cylindrical surface 30 which defines the wall of the combustion chamber 16 and has a predetermined inside diameter depending on the size of the engine. The split-ring-type spring will have an outside diameter (i.e., in the uncompressed state) which is greater than the inside diameter of the liner 18 so that it will bear against the inside surface 30 as the spring expands radially. The inside diameter of the springs 22 and 24 (i.e., in an uncompressed state) will be less than the outside diameter of the mandrel 20 so that the springs 22 and 24 will not come out of the grooves 26 and 28. The depth of the grooves 26 and 28 will be such that, upon compression, the split-ring-type spring can compress sufficiently to permit the springs 22, 24 to slide inside the liner 18 and push radially outwardly against the inner surface 30 to hold the liner 18 in place on the mandrel 20.

Figure 2:
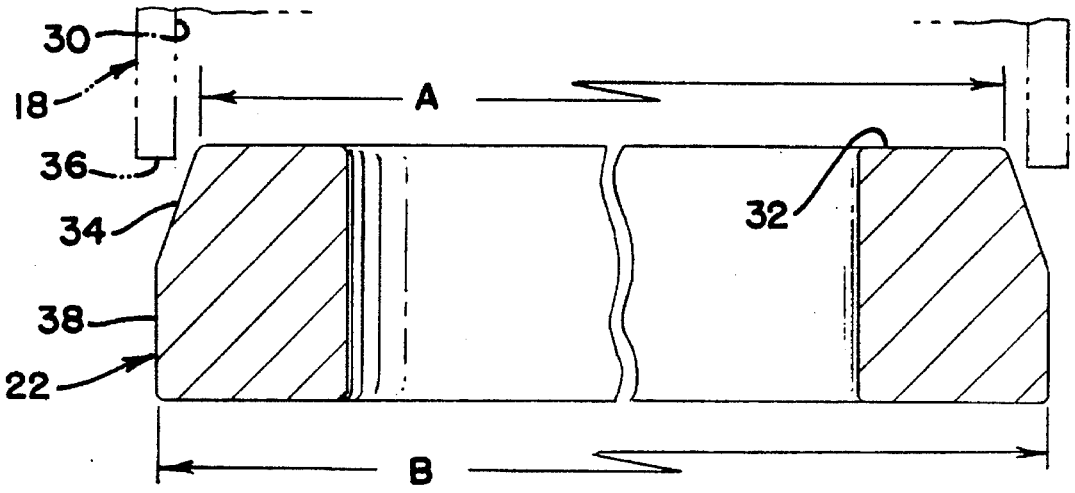
FIG. 2 is an enlarged sectional view of a split-ring-type spring in accordance with the present invention.

As best shown in FIG. 2, the split-ring-type spring 22 or 24 has a leading edge 32 which is chamfered at 34 so as to provide a frusto-conical shaped leading edge 32. When the split-ring-type spring is locked in place (to be described hereafter) the narrowest portion of the chamfer A will have a diameter less than the inside diameter of the liner 18 while the widest portion of the chamfer will have a diameter B which is greater than the inside diameter of the liner 18. Hence when the liner 18 is positioned over the mandrel 20, its leading edge 36 engages the chamfered surface 34 of the split-ring-type spring 22 and cams the split-ring-type spring 22 radially inwardly until the exterior face 38 of the spring slides along the inner surface 30 of the liner 18. The springs 22 and 24 apply a radially outwardly extending force which holds the liner 18 in place on the mandrel 20.

Figure 3:
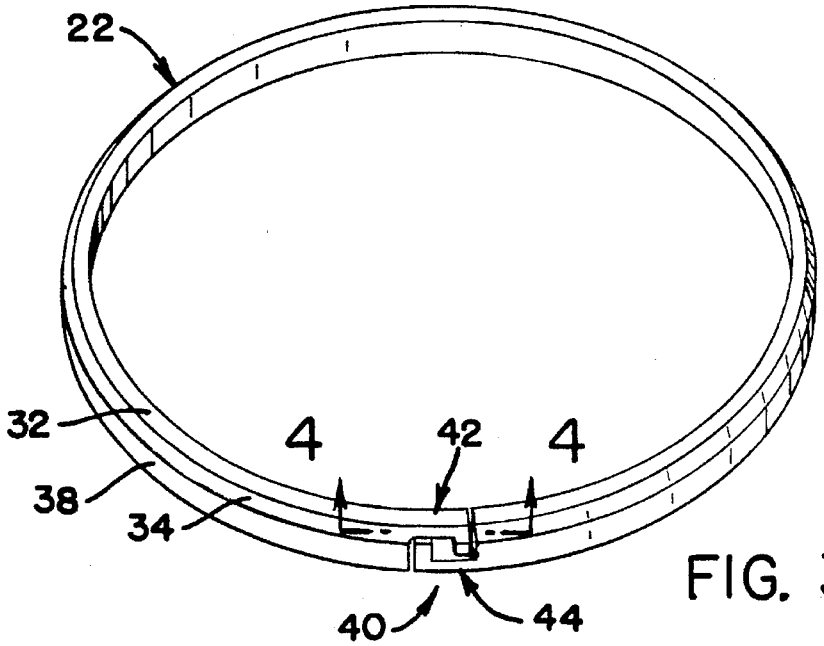
FIG. 3 is a perspective view of a split-ring-type spring in accordance with the present invention.
Figure 4:
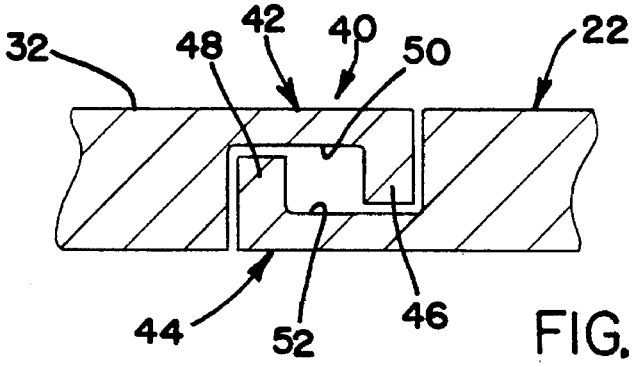
FIG. 4 is an enlarged sectioned view in the direction 4—4 of FIG. 3.

As best shown in FIG. 3, the ends of the split-ring-type spring include a sliplock 40 which prevent the spring 22 from either closing too small or opening too large. The sliplock 40 includes a pair of hooks 42 and 44 linked to each other as best shown in FIG. 4. More specifically, the hooks include a tenon 46 and 48 mating with mortises 50 and 52 in the opposite end of the spring 22. Hence once locked in place in the grooves 26 and 28, the spring 22 cannot come out of the grooves unless the hooks 42 and 44 are disengaged (e.g., by means of a screwdriver).

Use of springs in accordance with the present invention provides a simple and effective means for mounting the liner 18 to the mandrel 20 and requires relatively little pressure to press the mandrel 20 out of the liner 18 after the block has solidified. Moreover replacement of the springs 22, 24 is extremely simple when breakage or wear occurs.

While the invention has been disclosed solely in terms of one specific embodiment thereof it is not intended to be limited thereto but rather only to the extent set forth hereafter in the claims which follow.

What is claimed is:

1. In a die casting mold for casting a block for an internal combustion engine, said block having at least one combustion chamber defined by a discrete cylindrical liner having an inside diameter and inner cylindrical surface said liner being embedded in a mass of metal cast thereabout in a cavity of said mold, wherein said mold includes a reusable, cylindrical, detachable mandrel for positioning said liner in said cavity during casting and removable with said block after casting, the improvement comprising at least two spaced apart annular grooves in the outside surface of said mandrel;

a split-ring radially compressible and expansible spring in each of said grooves, said spring having (1) a leading edge, (2) a pair of ends proximate each other and moveable to and fro relative to each other during placement and displacement of said liner on and off said mandrel respectively, and (3) an outside diameter which is greater than said inside diameter of said liner when said spring is in an uncompressed state; and a chamfer on the leading edge of said spring for engaging an edge of said liner and camming said spring radially inwardly to a compressed state when said liner is slipped over said mandrel;

whereby, after said liner is positioned on said mandrel, said spring radially expands against the inner cylindrical surface of said liner and holds said liner in position on said mandrel.

2. A mold according to claim 1 including a sliplock on said ends for limiting the range of said to and fro movement.

3. A mold according to claim 2 wherein said mandrel has an outside diameter, said spring has an inside diameter, and the inside diameter of said spring is less than said outside diameter of said mandrel when spring expands radially outwardly as far as said sliplock will permit.

4. A mold according to claim 3 wherein said ends comprise a pair of opposing hooks linked to each other forming said sliplock.

* * * * *